US006875059B2

(12) United States Patent
Sivertsen

(10) Patent No.: US 6,875,059 B2
(45) Date of Patent: Apr. 5, 2005

(54) IN-LINE REMOTE CONTROLLABLE POWER SWITCH WITH INTEGRATED POWER SUPPLY

(75) Inventor: Clas Gerhard Sivertsen, Lilburn, GA (US)

(73) Assignee: American Megatrends, Inc., Norcross, GA (US)

( * ) Notice: Subject to any disclaimer, the term of this patent is extended or adjusted under 35 U.S.C. 154(b) by 0 days.

(21) Appl. No.: 10/342,501

(22) Filed: Jan. 15, 2003

(65) Prior Publication Data

US 2004/0137796 A1 Jul. 15, 2004

(51) Int. Cl.[7] ..... H01R 25/00
(52) U.S. Cl. ..... 439/638
(58) Field of Search ..... 439/638, 650, 439/620, 502; 307/112, 66, 119, 72, 137; 363/143, 147, 141; 320/134

(56) References Cited

U.S. PATENT DOCUMENTS 5,732,212 A 3/1998 Perholtz et al. ..... 395/200.11
5,907,197 A * 5/1999 Faulk ..... 307/119
5,961,619 A * 10/1999 Voloshin ..... 710/101
6,057,610 A * 5/2000 Nierescher ..... 307/72
6,160,728 A * 12/2000 Peterson et al. ..... 363/146
6,304,895 B1 10/2001 Schneider et al. ..... 709/203
6,465,913 B1 * 10/2002 Nagai et al. ..... 307/85

* cited by examiner

*Primary Examiner*—Alex Gilman
(74) *Attorney, Agent, or Firm*—Merchant & Gould

(57) ABSTRACT

An apparatus for powering one or more devices is provided. The apparatus includes a housing that has a power input connector that directly receives a power cord and a power output connector connected in series to the power input connector. The housing also contains a power supply connected in parallel to the power input connector. The power supply can generate power for delivery to a second powered device, such as a remote server management device. A cable assembly may extend from the housing for delivering power to the second powered device. The housing may also store a control circuit for controlling the flow of current between the power input connector and the power output connector. The control circuit receives an input signal and, based on the input signal, allows or prevents the flow of current to the integrated power output connector.

10 Claims, 7 Drawing Sheets

IN-LINE REMOTE CONTROLLABLE POWER SWITCH WITH INTEGRATED POWER SUPPLY

TECHNICAL FIELD

The present invention generally relates to the field of power supply devices and, more particularly, to the field of remote controlled power switches.

BACKGROUND OF THE INVENTION

Modern installations of server computers typically utilize a multitude of separate server computers installed in racks. Each rack may contain twenty or more separate server computers. Each server computer requires its own power cord to operate. Moreover, depending on the configuration, each server computer may require the use of several external powered devices to operate. For instance, a powered keyboard-video-mouse ("KVM") switch or other type of external device may be utilized within a server installation. Because many types of external devices require a power pack, such as a standard wall adapter, the number of power packs and power cords may quickly become unmanageable. This is also true for desktop computers which typically utilize an even greater number of external powered devices, such as universal serial bus ("USB") hubs, printers, external drive enclosures, and other types of devices.

One type of device that is commonly used in server installations is a remote server management device. Remote server management devices allow an administrator to remotely monitor and operate one or more server computers. Remote server management devices are either external or internal devices, and typically require the use of an external power pack. By issuing commands to a remote server management device, a server computer can be turned on, off, or rebooted. However, current server management devices suffer from several drawbacks that reduce their effectiveness with respect to controlling the power functions of a server computer. In particular, if the server computer is in a hung state, the server management device will be unable to shut down the operation of the server computer. Moreover, in order to allow the remote server management device to control the power functions of a server computer, a user typically has to make internal connections between the server computer and the management device. These connections can be difficult for a typical user to make without the assistance of a technician.

It is with respect to these considerations and others that the present invention has been made.

SUMMARY OF THE INVENTION

In accordance with the present invention, the above and other problems are solved by the present invention. In particular, the present invention reduces the amount of clutter caused by external powered devices used in conjunction with a computer system. Moreover, the present invention allows a remote server management device to control the power functions of one or more server computers even when in a locked state and without the need for special connections.

In accordance with other aspects, the present invention relates to an apparatus for powering one or more devices. The apparatus includes a housing that has a power input connector that directly receives a power cord, such as a standard power cord utilized by a computer system. The housing also has a power output connector connected in series to the power input connector. The power output connector may also be configured as a standard power connector, such as those utilized by typical computers. In this manner, a power cord can be plugged directly into the housing and the housing can be plugged directly into a computer or other type of powered device.

The housing also contains a power supply connected in parallel to the power input connector. The power supply can generate power for delivery to a second powered device, such as a remote server management device. A cable assembly may extend from the housing for delivering power to the second powered device. The power supply is typically configured for generating direct current. Moreover, the housing may also hold one or more externally mounted switches for controlling the flow of current to the power supply or to the power output connector.

In accordance with still other aspects, the present invention relates to an apparatus for remotely controlling a power switch. In particular, an apparatus is provided that includes a housing having an integrated power input connector and a connected integrated power output connector. The housing also stores a power supply for providing power to a second powered device. Additionally, the housing stores a control circuit for controlling the flow of current between the power input connector and the power output connector. The control circuit receives an input signal and, based on the input signal, allows or prevents the flow of current to the integrated power output connector.

The input signal to the control circuit may be provided along a cable assembly extending from the housing. The cable assembly may then be connected to a remote server management device or other type of powered device. The input signal may then be modified by the device to shut down the operation of the powered device connected to the integrated power output connector. A parallel bus connector may also be mounted on the external surface of the housing to expose the input signal to other devices. In this manner, a single remote server management device or other type of powered device may shut down multiple powered devices through a single connection.

These and various other features as well as advantages, which characterize the present invention, will be apparent from a reading of the following detailed description and a review of the associated drawings.

DETAILED DESCRIPTION OF THE INVENTION

Turning now to the drawings, in which like numerals represent like elements, various embodiments of the present invention will be described. It should be appreciated that the various embodiments of the invention are merely illustrative and that changes can be made without departing from the spirit and scope of the invention.

Figure 1B:
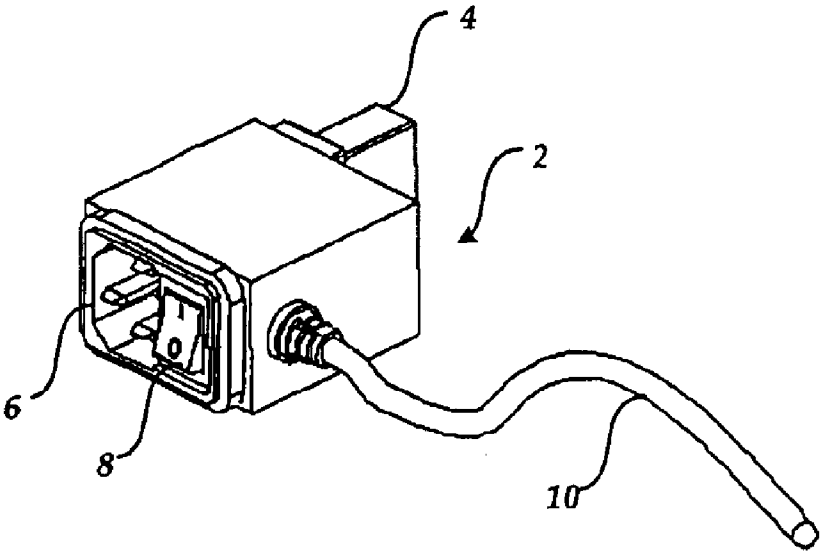
FIGS. 1A and 1B are perspective diagrams illustrating a device provided in one embodiment of the present invention.
Figure 1A:
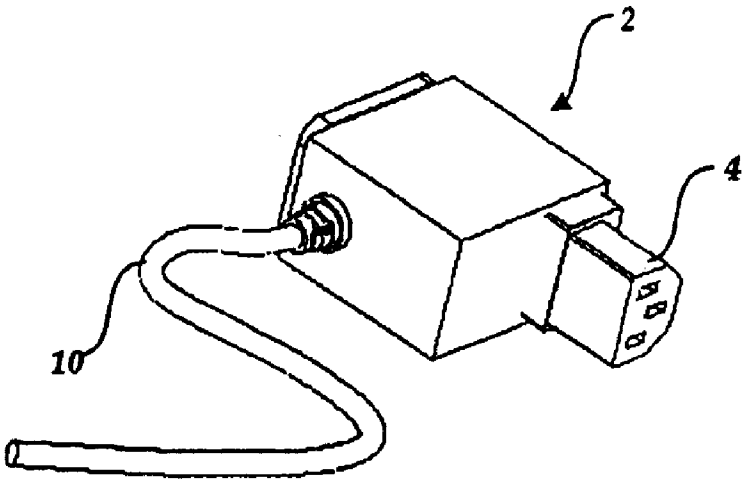

Referring now to FIGS. 1A and 1B, various aspects of one embodiment of the invention will be described. As discussed briefly above, embodiments of the invention provide a remote controllable power switch with an integrated power supply. According to one embodiment, the apparatus comprises a housing 2. The housing 2 is created from mold injected plastic or other type of suitable non-conducting material. The housing 2 includes an integrated power input connector 6 (also referred to as the "input connector" herein). The integrated power input connector 6 is operative to directly receive a power cord. In particular, according to one embodiment of the invention, the integrated power input connector 6 comprises an International Electrotechnical Commission ("IEC) IEC-320/C14 connector. It should also be appreciated that other types of connectors suitable for receiving a power cord may also be utilized.

As shown in FIGS. 1A and 1B, the housing 2 also comprises an integrated power output connector 4 (also referred to herein as the "output connector"). The integrated power output connector 4 is mounted directly to the housing 2 and is configured in a manner that allows the integrated power output connector 4 to be mated directly with a compatible input connector. In particular, according to one embodiment of the invention, the integrated power output connector 4 comprises an IEC-320/C13 connector that may be mated with an IEC-320/C14 connector utilized on many computer power supplies. In this manner, a power cord may be plugged directly into the integrated power input connector 6 and the integrated power output connector 4 may be plugged directly into the power receptacle of a powered device. It should be appreciated that other types of connectors may be utilized for the integrated power output connector 4.

As will be described in greater detail below, the integrated power input connector 6 and the integrated power output connector 4 are electrically connected in series, thereby allowing electrical current applied at the integrated power input connector 6 to be passed directly through to the integrated power output connector 4. As will also be discussed in greater detail below, a switch 8 may be mounted on and accessible from an external surface of the housing 2 and interposed between the integrated power input connector 6 and the integrated power output connector 4. In this manner, the flow of electrical current between the integrated power input connector 6 and the integrated power output connector 4 may be controlled through the use of the switch 8.

As will also be described in greater detail below, according to various embodiments of the invention, the housing 2 may also contain a power supply for powering an external powered device other than the device connected to the integrated power output connector 4. Power may be generated and delivered to the powered device through a cable assembly 10 extending from the housing 2. For instance, the power supply may be utilized to provide power to a remote server management device, a USB hub, or other type of device. According to various embodiments of the invention, the switch 8 may be utilized to control the operation of the power supply. Additional details regarding the various embodiments of the invention will be provided below with respect to FIGS. 2–7.

Figure 2:
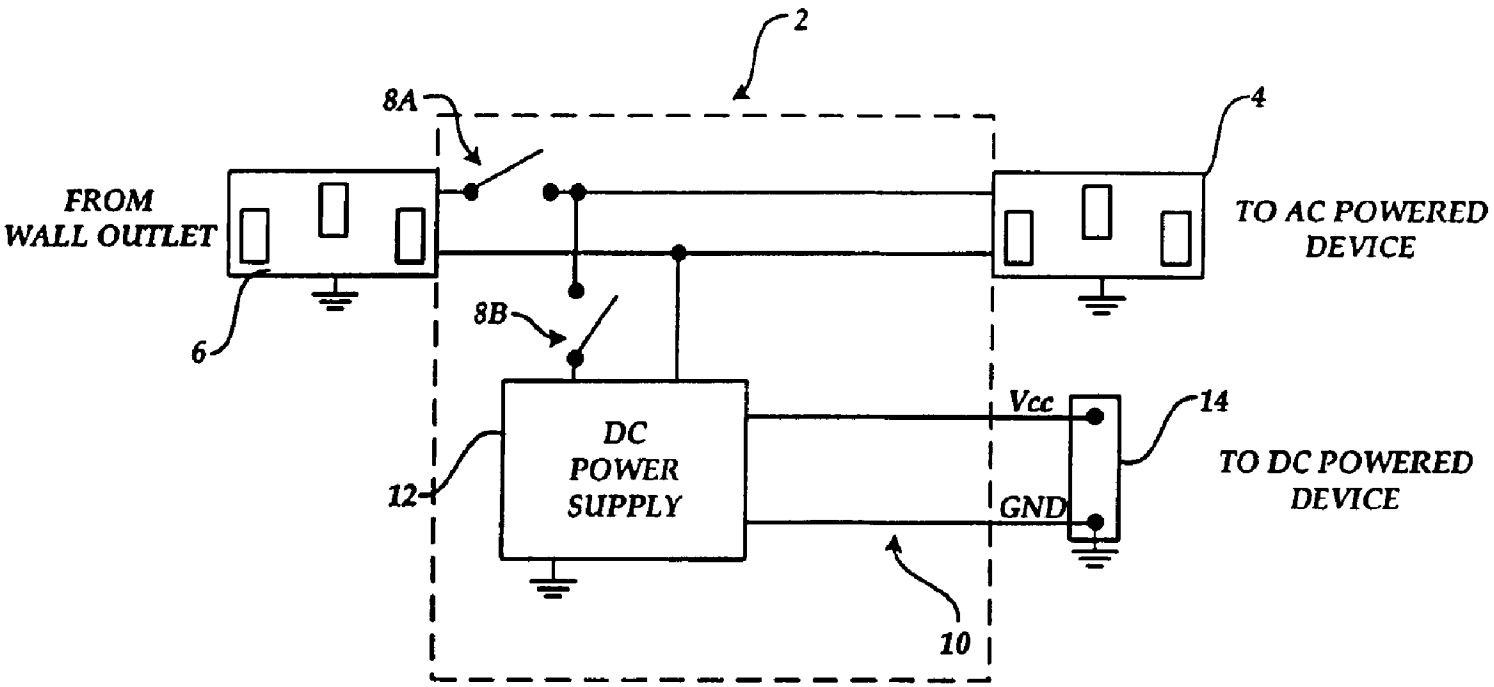
FIG. 2 is a circuit diagram illustrating aspects of one embodiment of the invention.

Referring now to FIG. 2, a circuit diagram will be described that illustrates a circuit for implementing one embodiment of the invention. As discussed briefly above, according to this embodiment of the invention, the housing 2 includes an integrated power input connector 6 and an integrated power output connector 4. The integrated power input connector 6 directly receives a power cord. The input connectors on the integrated power input connector 6 are connected in series to the appropriate connectors on the integrated power output connector 4, thereby passing alternating electrical current ("AC") applied at the input connector 6 to the output connector 4. In this manner, an AC powered device, such as the power supply of a computer system, may be directly powered by mating the power output connector 4 to the appropriate connector of the power supply.

As also described briefly above, according to one embodiment, a switch 8A may be interposed between the input connector 6 and the output connector 4, thereby preventing the flow of current between the input connector 6 and the output connector 4 when in an open position. The switch 8A may be mounted on and accessible from an external portion of the housing 2. By using the switch 8A, a user may easily remove power from the integrated power output connector 4.

According to another embodiment of the invention, the housing 2 may be utilized to store a power supply 12. In particular, according to one embodiment of the invention, the power supply 12 may comprise a direct current ("DC") power supply operative to generated power for powering an external device. The power supply 12 may be connected in parallel to the integrated power input connector 6. The output of the power supply 12 may be supplied external to the housing 2 through a connected cable assembly 10. The cable assembly and a terminating connector 14 compatible for use with a power input connector on a powered device may be utilized to provide power to the powered device.

As also described briefly above, according to one embodiment, a switch 8B may be interposed between the integrated power input connector 6 and the power supply 12, thereby preventing the flow of current between the input connector 6 and the power supply 12 when in an open position. The switch 8A may be mounted on and accessible from an external portion of the housing 2. By using the switch 8A, a user may easily remove supply power from the power supply 12, thereby eliminating the output voltage of the power supply 12. In this manner, the powered device may be conveniently turned on and off.

Figure 3:
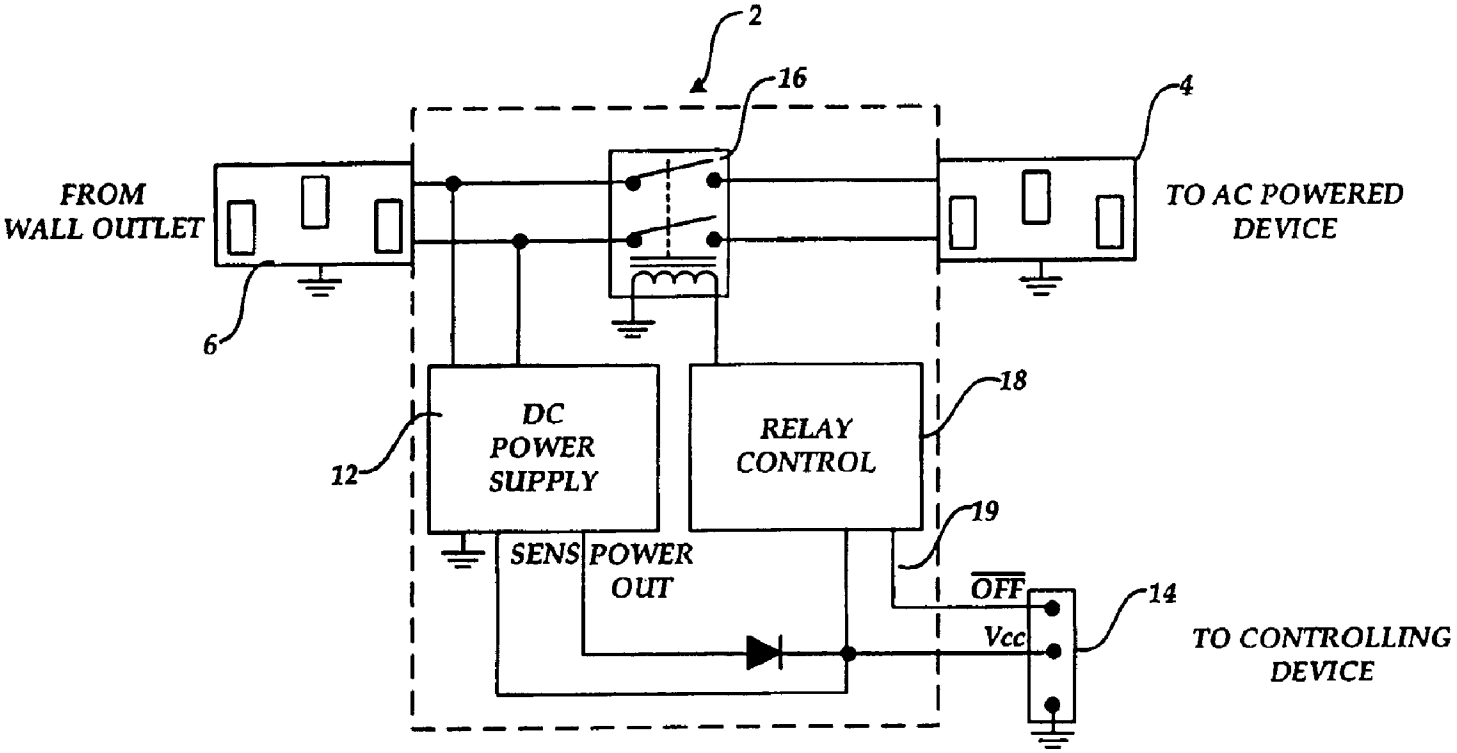
FIG. 3 is a circuit diagram illustrating aspects of another embodiment of the invention.

Referring now to FIG. 3, a circuit diagram will be described that illustrates a circuit for implementing another actual embodiment of the invention. As discussed briefly above, according to this embodiment of the invention, the housing 2 includes an integrated power input connector 6 and an integrated power output connector 4. The input connectors on the integrated power input connector 6 are connected in series to the appropriate connectors on the integrated power output connector 4, thereby passing AC applied at the input connector 6 to the output connector 4. In this manner, an AC powered device, such as the power supply of a computer system, may be directly powered by mating the power output connector 4 to the appropriate connector of the power supply.

According to this embodiment of the invention, the housing 2 may be utilized to store a power supply 12 operative to generated power for powering an external device. The power supply 12 may be connected in parallel to the integrated power input connector 6. The output of the power supply 12 may be supplied external to the housing 2 through a connected cable assembly 10. The cable assembly and a terminating connector 14 compatible for use with a power input connector on a powered device may be utilized to provide power to the powered device.

According to this embodiment of the invention, the housing 2 is also utilized to house a control circuit that receives an input signal and, based on the status of the input signal, either allows or prevents the flow of current between the input connector 6 and the output connector 4. In particular, according to one embodiment of the invention, the housing 2 includes a relay control 18 and a relay 16. The relay 16 is interposed between the input connector 6 and the output connector 4. The relay control 18 comprises a circuit for controlling the operation of the relay 16 based upon the status of an input signal 19. The input signal 19, as well as power generated by the power supply 12, are exposed on the cable assembly and the terminating connector 14. In this manner, the input signal 19 for controlling the operation of the relay 16 are available for control by external devices. Therefore, an external device, such as a remote server management device, may be powered by the power supply 12 and also control the flow of power to the output connector 4. This may be useful, for instance, when it is necessary for the remote server management device to shut down the operation of a server computer by removing power to the output connector 4. Additional details regarding the power supply 12 and the relay control 18 will be provided below with respect to FIGS. 4 and 5, respectively.

Figure 4:
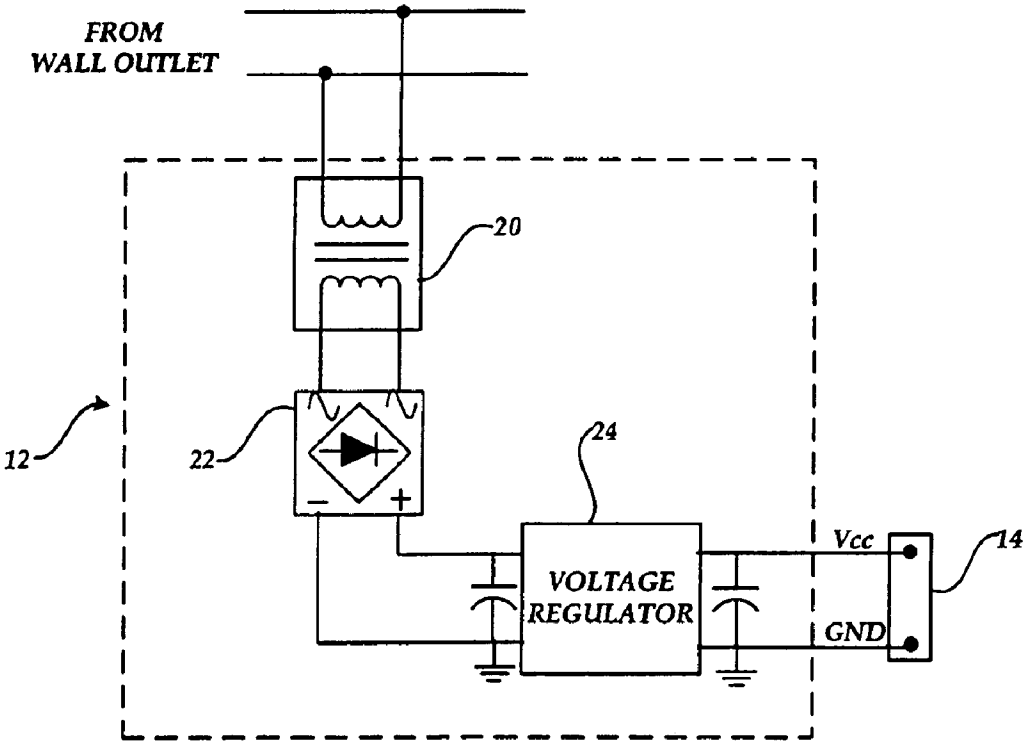
FIG. 4 is a circuit diagram illustrating a power supply utilized in one embodiment of the invention.

Turning now to FIG. 4, an illustrative power supply 12 utilized in one embodiment of the invention will be described. As discussed briefly above, the power supply 12 comprises a DC power supply in one embodiment of the invention. In particular, according to one embodiment of the invention, the power supply 12 comprises a transformer 20 connected in parallel with the input connector 6. The outputs of the transformer 20 are connected in series to a diode rectifier bridge 22. In turn, the outputs of the diode rectifier bridge 22 are connected to a voltage regulator 24. The DC power output of the voltage regulator 24 is then routed outside the housing 2 via the cable assembly 10. As discussed above, the power output terminates at a terminating connector 14 that is compatible with a power input connector on a DC powered device. It should be appreciated that although the power supply described herein is a DC power supply, other types of power supplies may be utilized to power different types of devices. For instance, a universal power supply with a user-selectable voltage may be utilized in conjunction with a variety of differently sized terminating connectors 14. In this manner, the apparatus may be utilized to power a variety of devices having different voltage requirements. Moreover, multiple cable assemblies may be utilized to power several devices concurrently.

Figure 5:
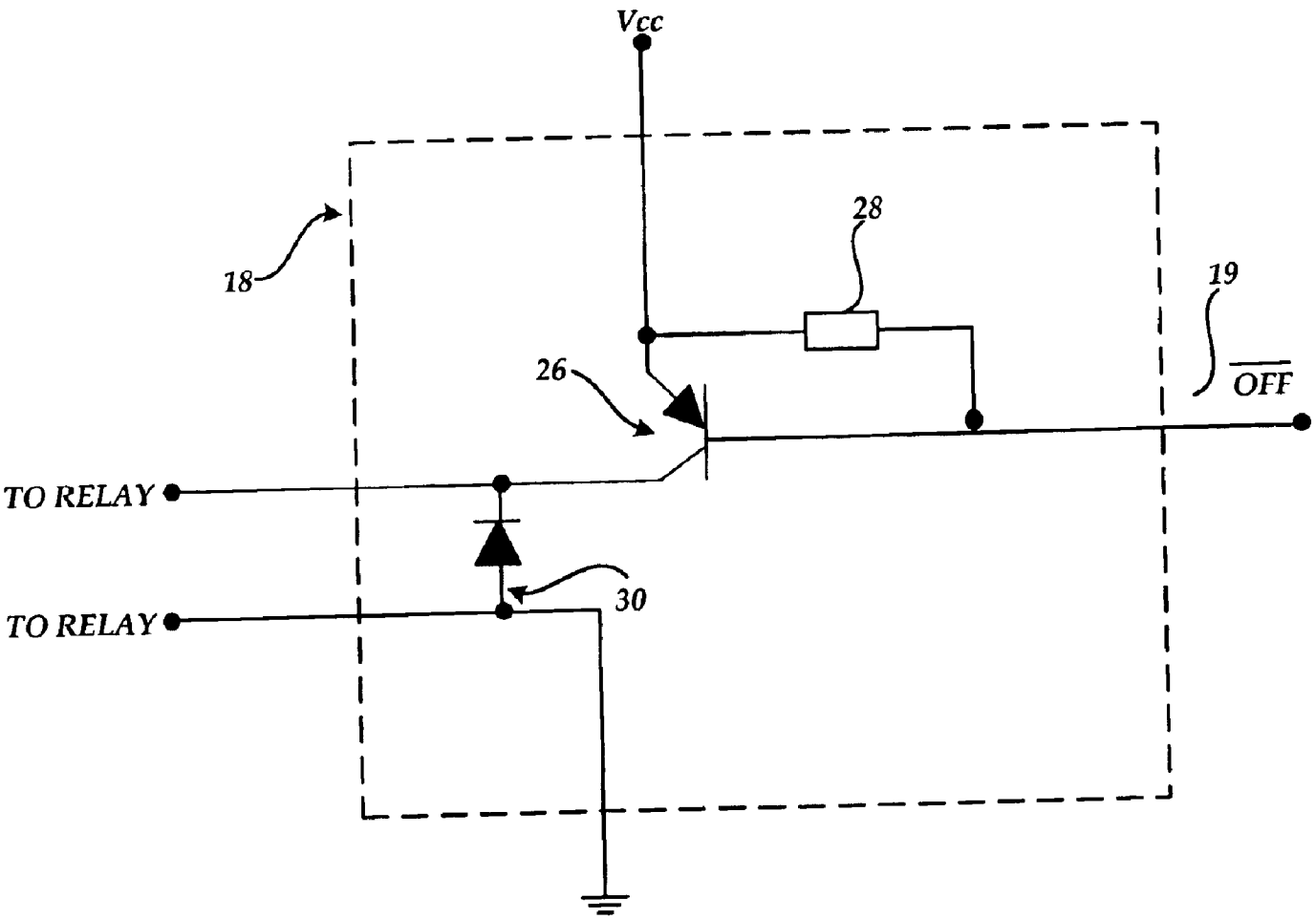
FIG. 5 is a circuit diagram showing an illustrative relay control circuit provided in one embodiment of the invention.

Referring now to FIG. 5, an illustrative circuit for controlling the operation of a relay 16 according to one embodiment of the invention will be described. As discussed briefly above, the relay control 18 provides an input signal 19 that may be utilized by an external device to control the operation of the relay 16 and, consequently, the delivery of power to the output connector 4. More particularly, according to one embodiment of the invention, a PNP transistor 26 is utilized as the basis for the relay control 18. The emitter of the PNP transistor 26 is connected to voltage and the input signal 19 is connected to the base in conjunction with a pull-up resistor 28. It should be appreciated that the input signal 19 is an open collector input. The collector of the PNP transistor 26 is connected to one input of the relay 16. The other input of the relay 16 is connected to ground and a reverse voltage protection diode 30 is interposed between the inputs of the relay 16. In this manner, when the input signal 19 is driven low by an external device, the PNP transistor 26 operates to open the relay 16, thereby eliminating the flow of current between the input connector 6 and the output connector 4. Although the control circuit has been described herein as a relay utilized in conjunction with a PNP transistor-based relay control 18, it should be appreciated that other types of control schemes may be utilized.

Figure 6B:
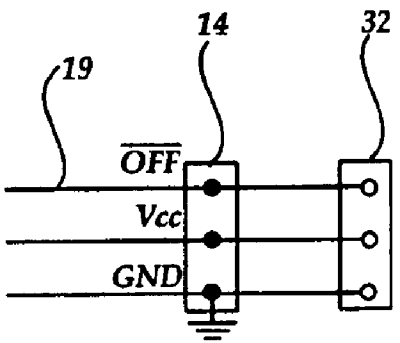
FIG. 6B is a circuit diagram illustrating a daisy chain connector provided by one embodiment of the present invention.
Figure 6A:
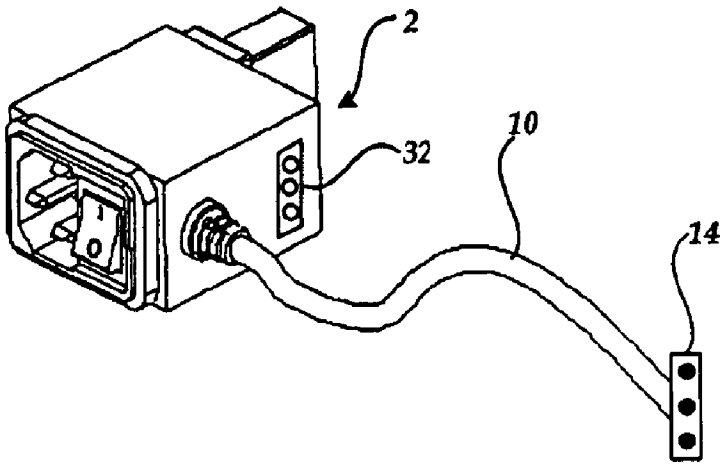
FIG. 6A is a perspective diagram illustrating a cable assembly and connectors utilized by various embodiments of the invention.

Turning now to FIGS. 6A and 6B, a cable assembly and daisy chain connector utilized in various embodiments of the invention will be described. As shown in FIG. 6A and described briefly above, the output of the power supply 12 may be provided to external devices through a cable assembly 10. The cable assembly 10 is terminated with a terminating connector 14 that includes connectors for power and ground. The terminating connector 14 also includes a connector for the input signal 19 for controlling the relay control 18. In this manner, a single cable assembly 10 can be utilized to both power an external device and to expose the input signal 19 necessary for the external device to control the flow of power to the output connector 4.

Figure 7:
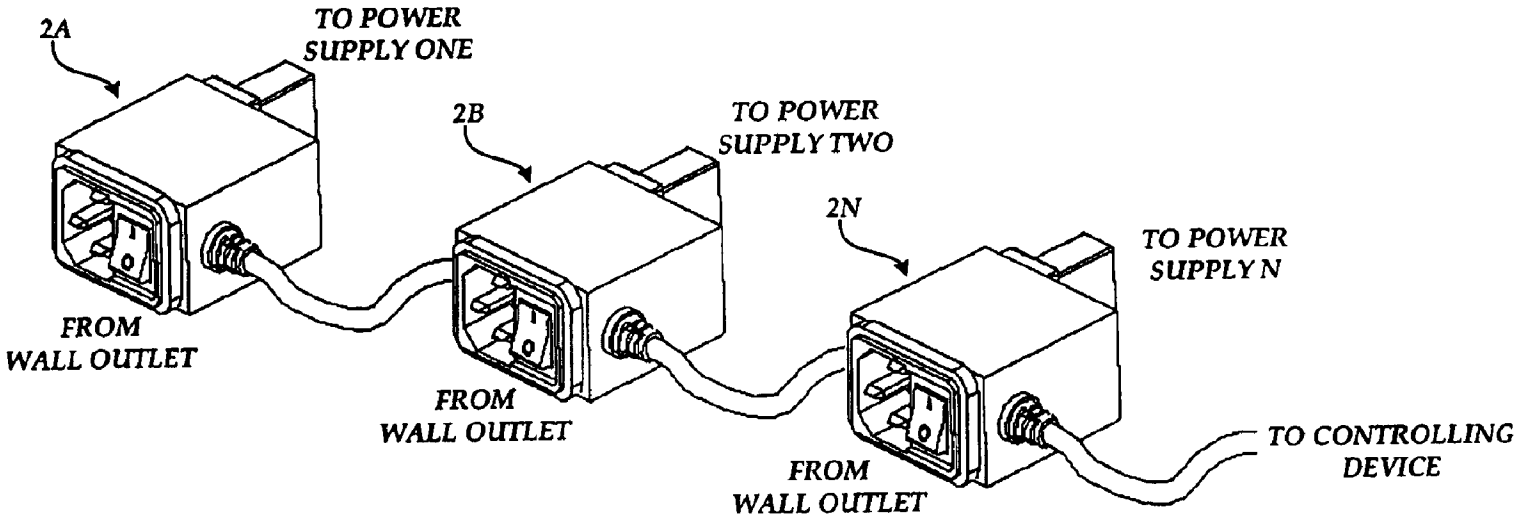
FIG. 7 is a perspective diagram illustrating the use of several devices in a parallel configuration according to one embodiment of the invention.

According to one embodiment of the invention, the housing 2 also includes a daisy chain connector 32. As shown in FIGS. 6A and 6B, the daisy chain connector 32 provides an input connector for ground, power, and the input signal 19. As shown in FIG. 6B, the connectors of the daisy chain connector 32 are connected in parallel to the output connectors of the terminating connector 14, thereby creating a bus. Moreover, the daisy chain connector 32 is compatible with the terminating connector 14. As shown in FIG. 7, multiple devices 2A–2N may be daisy chained together. A single external powered device connected to the daisy chain may then control the power delivered by each of the devices. This may be useful, for instance, when a server computer utilizes multiple power supplies. Moreover, because the power, ground, and input signal 19 are on a bus, the power supply in one device may drive the relay of another device in the event that the power supply in that device fails.

Based on the foregoing, it should be appreciated that embodiments of the invention provide an in-line remote controllable power switch with an integrated power supply. The above specification, examples and data provide a complete description of the manufacture and use of the composition of the invention. Since many embodiments of the invention can be made without departing from the spirit and scope of the invention, the invention resides in the claims hereinafter appended.

I claim:

1. An apparatus for providing power to one or more devices, the apparatus comprising:

a housing comprising an integrated power input connector for directly receiving a power cord and an integrated first power output connector connected in series to the integrated power input connector, the first power output connector configured to mate directly with a power input connector on a first powered device;

a power supply mounted within the housing, the power supply connected in parallel to the power input connector and operative to generate power for delivery through a second output connector to at least a second powered device; and a control circuit mounted within the housing, the circuit operative to receive an input signal from the second powered device and, based on the input signal, to allow or prevent the flow of alternating current to the integrated first power output connector, so as to selectably shut down the first powered device.

2. The apparatus of claim 1, further comprising a cable assembly extending from the housing, the cable assembly electrically connected to an output of the power supply and operative to deliver power to the second powered device.

3. The apparatus of claim 2, wherein the cable assembly is terminated with a connector compatible with a power input on the second powered device.

4. The apparatus of claim 3, wherein the cable assembly further comprises an electrical connection to the input signal and wherein the second powered device is operative to control the input signal.

5. The apparatus of claim 4, further comprising a parallel bus connector mounted on an external surface of the housing, the bus connector having electrical connections to the input signal and the power supply.

6. The apparatus of claim 5, wherein the bus connector is compatible with the terminating connector on the cable assembly.

7. The apparatus of claim 6, wherein the integrated power input connector comprises an IEC-320/C14 connector.

8. The apparatus of claim 7, wherein the integrated power output connector comprises an IEC-320/C13 connector.

9. Apparatus for providing power to a plurality of devices and for enabling power control of a first such device by a second such device, the apparatus comprising:

a housing having an input connector for receiving a source of electrical power and having a first power output connector for connection to the first device;

a power supply within the housing, the power supply receiving input power from the input connector and converting that electrical power into operating power supplied to a second output connector of the housing for connection to the second device;

a switch within the housing in circuit between the input connector and the first output connector, the switch being selectably operative in response to power from the power supply to establish or to interrupt a power connection from the input connector to the first output connector; and a switch control within the housing and selectably operative, in response to an input signal from the second device, to control the switch so as to interrupt the power connection from the input connector to the first output connector, so that the first device receiving power from the first output connector is powered down in response to the input signal, independently of an operating condition of that first device.

10. The apparatus as in claim 9, wherein the second output connector includes an electrical connection for receiving the input signal and supplying the input signal to the switch control, so that the second output connector is operative to supply converted electrical power to the second device and to receive the input signal from the second device to selectably interrupt electrical power to the first device.

* * * * *